United States Patent [19]

Turko

[11] 3,934,496

[45] Jan. 27, 1976

[54] COUNTERBALANCE MECHANISM FOR FUME HOODS

[75] Inventor: Michael Turko, Manitowoc, Wis.

[73] Assignee: American Hospital Supply Corporation, Evanston, Ill.

[22] Filed: Oct. 23, 1974

[21] Appl. No.: 517,100

[52] U.S. Cl. ..... 98/115 LH; 16/193; 49/200; 49/445; 187/94

[51] Int. Cl.[2] ..... F23J 11/00

[58] Field of Search .... 98/115 R, 115 LH, 115 VM; 49/200, 445; 16/193, 194; 187/94

[56] References Cited

UNITED STATES PATENTS

| | | | |
|---|---|---|---|
| 684,390 | 10/1901 | Venn | 187/94 |
| 735,093 | 4/1903 | Greenwald | 187/94 |
| 3,064,829 | 11/1962 | Winfrey et al. | 187/94 X |
| 3,101,130 | 8/1963 | Bianca | 187/94 X |
| 3,745,908 | 7/1973 | Mayberry | 98/115 LH |

*Primary Examiner*—William F. O'Dea
*Assistant Examiner*—Ronald C. Capossela

[57] ABSTRACT

A counterbalance for a fume hood is located behind the back of the hood and is connected to each side of the sash by a pair of cable portions which are routed from the counterblanace over the top of the hood by pulleys on the top of the hood. The counterbalance comprises a container which can be filled with a desired amount of weight material, and a roller on the container is engageable with the back of the hood to prevent sliding contact between the counterbalance and the hood. The weight of the sash can be adjusted to equal the weight of the counterbalance by inserting weights into a weight-receiving receptacle formed in the frame member attached to the upper edge of the sash glass.

14 Claims, 7 Drawing Figures

COUNTERBALANCE MECHANISM FOR FUME HOODS

BACKGROUND

Fume hoods which are equipped with sashes conventionally include sash counterbalances to facilitate raising and lowering the sash and to maintain the sash in the desired position. A typical sash counterbalance arrangement includes two sash weights which are concealed within opposite front corners of the fume hood and connected to the sash by cables which are routed over pulleys at the top of the hood. Such sash weights often bump and scrape inside surfaces of the fume hood as the sash is raised or lowered, causing irritating noises. Further, if one of the connecting cables breaks, the remaining single sash weight is insufficient to balance the weight of the sash, and the sash drops.

At least one fume hood uses a single sash weight concealed in a front corner post which is connected to both sides of the sash by cables. If one of the cables breaks, the counter-balance is maintained. However, the sash weight can still bump and scrape the inside of the corner post as it moves up and down.

SUMMARY

The invention provides a silent, smoothly operating sash which maintains the counterbalance in the event of cable breakage. The counterbalance mechanism also includes an adjustment feature which compensates for differences in the weight of the sash caused by varying thickness of the glass, etc. and which permits equalization of the sash weight with the counterbalance weight. The counterbalance is provided by a container which is located behind the hood and which is equipped with rollers to prevent sliding contact with the back of the hood. The ends of a single cable are connected to opposite sides of the sash and are routed over the top of the hood by pulleys. The middle of the cable is attached to the container, and if one of the cable branches breaks, the other branch will maintain the counterbalance. The weight of the counterbalance can be varied as desired by adding weight material such as scrap metal, and during final assembly the weight of the sash may be equalized with the weight of the counterbalance by adding weights to the channel-shaped frame member which is attached to the upper edge of the sash glass. In single weight counterbalance systems, the entire counterbalance weight works against sash cocking. In twoweight counterbalance systems, only one-half of the counterbalance weight works to prevent cocking. A single weight system therefore provides smoother operation.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
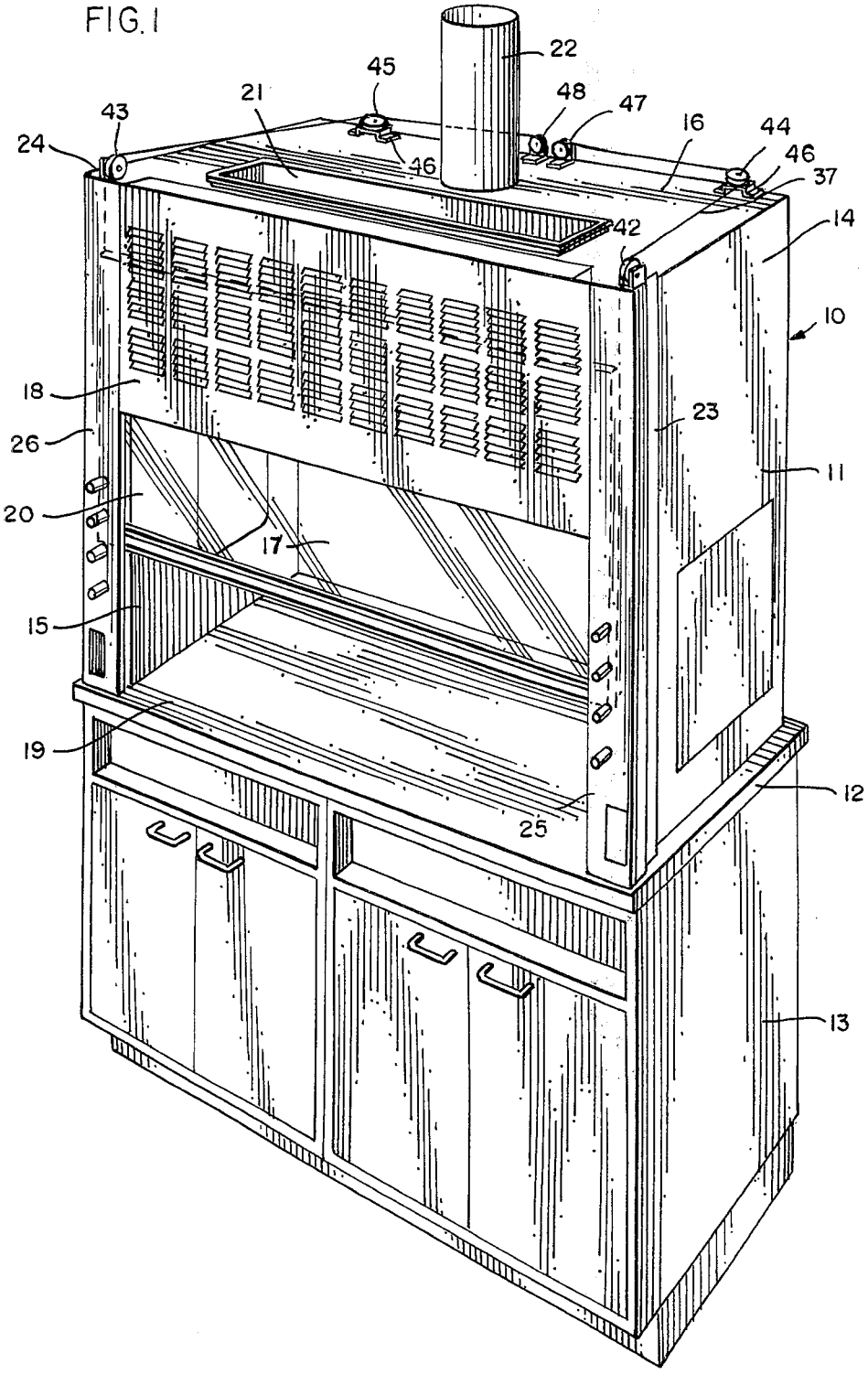
FIG. 1 is a perspective view of a fume hood equipped with a sash counterbalance mechanism formed in accordance with the invention.
Figure 2:
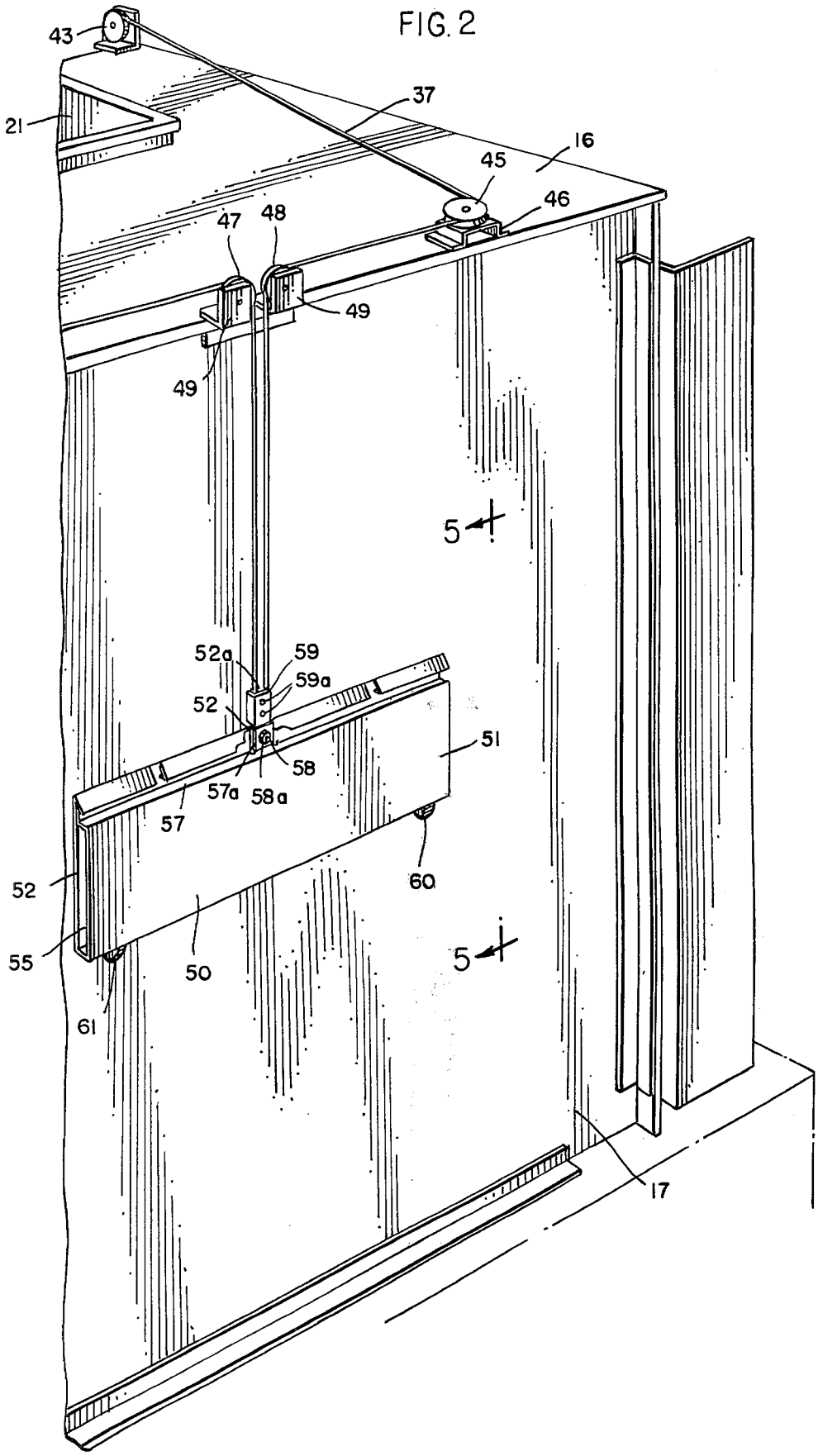
FIG. 2 is a fragmentary rear perspective view of the fume hood.

FIG. 1 illustrates a conventional fume hood 10 which includes a superstructure 11 mounted on a counter 12 above a support cabinet 13. The superstructure includes right and left walls 14 and 15, top wall 16, rear wall 17, and a relatively short front panel 18 which terminates above the counter top to provide an access opening 19. A sash 20 is slidably mounted in the side walls and is movable vertically between a fully lowered position in which it closes the access opening and a fully raised position in which its lower edge is adjacent the bottom of the front panel 18. Since the structure of such a fume hood is well-known, a detailed description thereof is unnecessary.

A light opening 21 is provided through the top wall 16, and an exhaust tube 22 communicates with the working chamber formed by the walls of the hood. In use, the exhaust tube is connected to an exhaust blower to exhaust fumes from the working chamber.

The side walls 14 and 15 are secured to right and left corner posts 23 and 24, respectively, and right and left front access panels 25 and 26 are also secured to the corner posts substantially perpendicularly to the side walls. In the completed hood, a finished end panel (not shown) would generally extend rearwardly from the outer edge of each front access panel parallel to the adjacent side wall. Similarly, upper enclosure panels would extend across the front and the sides of the fume hood to conceal the top of the hood.

The sash includes a rectangular glass panel 28 and upper and lower edge mounts or frame members 29 and 30 (see also FIGS. 3, 4, 6, and 7), and each side edge of the sash glass is slidably received in a vertical channel or sash guide 31 (FIG. 3) secured to each corner post.

Figure 3:
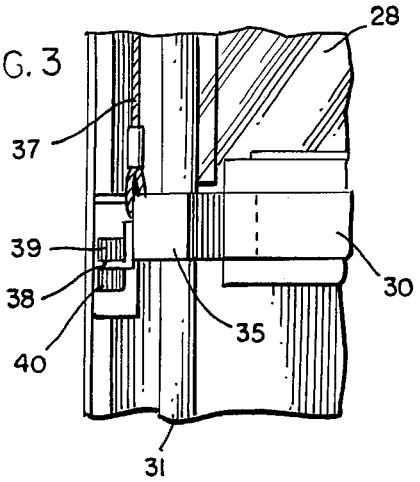
FIG. 3 is a fragmentary front elevational view of the lower left corner of the sash with the front access panel of the fume hood removed.
Figure 4:
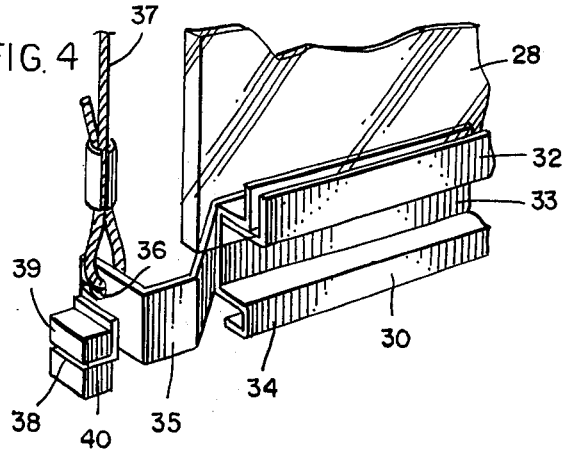
FIG. 4 is a perspective view of the lower left corner of the sash.
Figure 6:
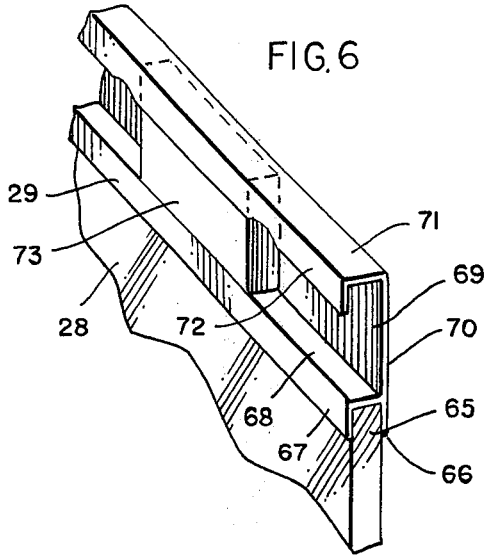
FIG. 6 is a perspective view of the upper right corner of the sash.

Referring now to FIGS. 3 and 4, the lower edge mount 30 includes an upwardly opening channel portion 32 which is clamped over the lower edge of the sash panel, a generally U-shaped intermediate portion 33, and an L-shaped lower portion 34 which engages the counter top 11 when the sash is fully lowered. A somewhat V-shaped cable-attaching finger 35 is secured to each end of the lower edge mount and extends outwardly and in front of the sash guide 31 and then rearwardly. An L-shaped cable slot 36 is provided in the rearwardly extending portion of each finger and receives the looped end of a sash cable 37. An L-shaped bumper support 38 is mounted below the slot, and upper and lower bumper stops 39 and 40 are cemented to the bumper support to cushion the upper and lower stops of the sash.

Referring again to FIG. 1, pulleys 42 and 43 are rotatably mounted on the upper ends of the right and left corner posts for rotation about a horizontal axis, and rear pulleys 44 and 45 are rotatably mounted for rotation about a vertical axis. Each of the rear pulleys is mounted on a support bracket 46 attached to the top wall 16. A third pair of pulleys 47 and 48 is also mounted at the rear of the top wall in the middle of the hood, and these pulleys are mounted for rotation about horizontal axes which extend parallel to the midplane of the hood by brackets 49.

The three pairs of pulleys are used to route the sash cable 37 upwardly from each of the cable tightening attaching fingers 35, rearwardly over the top of the hood to the pulleys 44 and 45, laterally inwardly to the pulleys 47 and 48, and then downwardly behind the back wall 17 to a counterbalance 50. In the embodiment illustrated, the two ends of a single cable are used to connect the sides of the sash to the counterbalance, and the middle of the cable is attached to the counterbalance. The cable is thus divided into right and left cable portions or branches, each of which connects one side of the sash to the counterbalance.

The counterbalance includes a relatively narrow, elongated container 51 having front and rear walls 52 and 53 (FIG. 5), a pair of narrow side walls 54 and 55, a bottom wall 56, and a top wall 57. A lug 57*a* extends upwardly from the midportion of the top wall slightly behind the front wall 52, and the midpoint of the cable 37 extends around a bolt 58 which extends through the front wall 52 and the lug 57*a* and which is secured by a nut 58*a*. Both branches of the cable are securely clamped to the counterbalance by a U-shaped clamp 59 which is secured by screws 59*a* to a lug 52*a* which is formed as an upward extension of the front wall 52. A pair of rollers 60 and 61 are rotatably mounted on the bottom wall of the container by mounting brackets 62. The axle of each roller extends through slots 63 in the mounting bracket, and the axle is spring-loaded toward the front of the slots in the conventional manner. The weight of the counterbalance can be adjusted as desired by filling the container with ballast or weight material such as scrap metal or the like.

Figure 7:
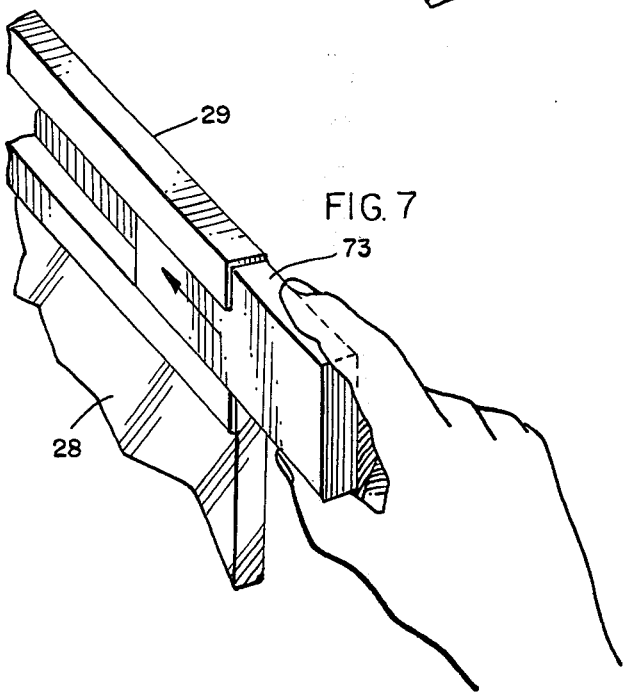
FIG. 7 is a view similar to FIG. 6 showing one of the compensating weights being inserted.

A final adjustment of the counterbalance mechanism is provided by the upper edge mount 29 (FIGS. 6 and 7) of the sash glass. This edge mount includes a downwardly opening channel 65 provided by a pair of spaced-apart legs 66 and 67 and a middle leg 68 and a forwardly opening channel 69 provided by an upwardly extending back wall 70, a top wall 71, and a depending front wall 72. The upper edge mount is secured by crimping the legs 66 and 67 about the upper edge of the sash glass, and the total weight of the sash can be equalized with the weight of the counterbalance by sliding one or more weights 73 into the channel or receptacle 69 as illustrated in FIG. 7. When the desired weight of the sash is obtained, the weights can be retained within the channel 69 by crimping the walls 70 and 72 against the weights.

The thickness of the glass used in the sash may vary, and on large hoods the difference in glass thickness can result in a difference in total sash weight of as much as five pounds. The upper edge mount permits compensation for this weight variance.

The adjustable weight feature of the sash counterbalance mechanism not only ensures equalization of the weights of the sash and the counterbalance but facilitates assembly of the fume hood. The counterbalance containers 51 are prepared before the hoods are assembled, and enough ballast is added to make the weight of the counterbalance greater than the expected total weight of the sash. After the hood is assembled, compensating weights 73 of a sufficient number and/or size are inserted into the upper edge mount to make the total weight of the sash equal to the weight of the counterbalance.

It is generally more convenient during assembly to add weight to the sash than to add weight to the counterbalance, and this is permitted by the upper edge mount. However, before the hood is installed, ballast could also be added to or removed from the counterbalance container as desired.

The weight adjustment feature also facilitates replacement of the sash glass. The weight of the new sash glass may be different than the weight of the old glass, and this difference can be compensated for by adding or removing weights 73 from the edge mount. In the case of a replacement sash glass it may be difficult to obtain access to the counterbalance container, which is located behind the hood.

Figure 5:
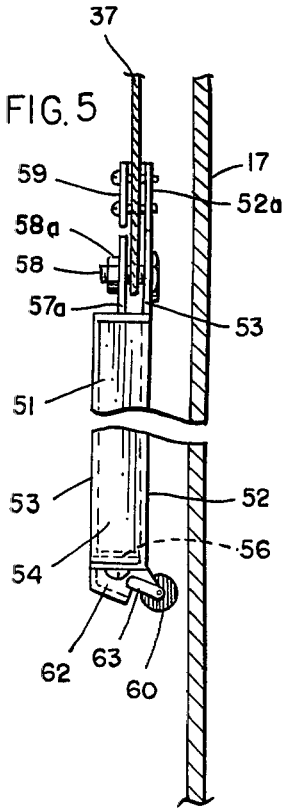
FIG. 5 is a fragmentary sectional view of the sash counterbalance taken along the line 5—5 of FIG. 2.

The operation of the sash and the counterbalance mechanism will be apparent from the foregoing. Once the weights of the sash and the counterbalance are equalized, the sash can be raised and lowered silently and smoothly, and the sash will be maintained in any desired position. The counterbalance is located behind the hood, and the cable branches are routed upwardly alongside the corner posts and over the top of the hood by the rotating pulleys. The middle pulleys 47 and 48 are positioned slightly rearwardly of the back wall of the hood by the mounting brackets 49, and the counterbalance container is suspended away from the back wall (FIG. 5). The container is thus generally raised and lowered without contacting the hood, and scraping noises are eliminated. In the event that the container swings into contact with the back wall, the spring-loaded rollers 60 and 61 will cushion the impact and will provide rolling contact with the back wall rather than scraping or sliding contact.

Although in the embodiment illustrated a single cable is used to connect the sash to the counterbalance, the middle of the cable is clamped to the counterbalance. Thus, if one of the branches of the cable breaks, the other branch will remain connected to the counterbalance, and the sash will not drop. Since the counterbalance weight will be exerted on only one side of the sash, the sash will cock, thereby alerting the user to replace the cable.

While in the foregoing specification a detailed description of a specific embodiment of the invention was set forth for the purpose of illustration, it is to be understood that many of the details herein given may be varied considerably by those skilled in the art without departing from the spirit and scope of the invention.

I claim:

1. In a fume hood having a top, a back, and right and left sides forming a working chamber and a sash mounted for movement between raised and lowered positions for opening or closing the working chamber, an improved sash counterbalance apparatus comprising a single cable having a pair of ends, each end of the cable being attached to the sides of the sash to provide right and left portions of the cable, cable routing means on the top of the fume hood for routing the right and left portions of the cable over the top of the hood and down the back thereof, a counterbalance behind the back of the hood, and a clamp on the counterbalance clampingly securing the right and left portions of the cable whereby if one of the right and left cable portions breaks the other cable portion remains attached to the counterbalance.

2. The structure of claim 1 in which the counterbalance comprises a container and weight material within the container whereby the weight of the counterbalance can be varied by adding or removing weight material to or from the container.

3. In a fume hood having a top, a back, and right and left sides forming a working chamber and a sash mounted for movement between raised and lowered positions for opening or closing the working chamber, an improved sash counterbalance apparatus comprising right and left cable means attached to right and left sides of the sash for operatively connecting a counterbalance to the sash, cable routing means on the top of the fume hood for routing the cable means over the top of the hood and down the back thereof, a counterbalance behind the back of the hood attached to the right and left cable means, the sash including a glass panel and a frame member attached to the upper edge of the glass panel, the frame member having a receptacle for receiving weights whereby the total weight of the sash can be adjusted relative to the weight of the counterbalance by inserting one or more weights into the receptacle.

4. The structure of claim 3 in which the receptacle is formed by a generally channel-shaped portion of the frame member.

5. In a fume hood having a top, a back, and right and left sides forming a working chamber and a sash mounted for movement between raised and lowered positions for opening or closing the working chamber, an improved sash counterbalance apparatus comprising right and left cable means attached to right and left sides of the sash for operatively connecting a counterbalance to the sash, cable routing means on the top of the fume hood for routing the cable means over the top of the hood and down the back thereof, a counterbalance behind the back of the hood attached on the right and left cable means, and a roller rotatably mounted on the counterbalance and engageable with the back of the hood for preventing sliding contact between the counterbalance and the back of the hood as the sash is raised and lowered.

6. The structure of claim 5 in which the counterbalance comprises a container and weight material within the container whereby the weight of the counterbalance can be varied by adding or removing weight material to or from the container.

7. In a fume hood having a top, a back, and right and left sides forming a working chamber and a sash mounted for movement between raised and lowered positions for opening or closing the working chamber, an improved sash counterbalance apparatus comprising right and left cable means attached to right and left sides of the sash for operatively connecting a counterbalance to the sash, cable routing means on the top of the fume hood for routing the cable means over the top of the hood and down the back thereof, a counterbalance behind the back of the hood attached to the right and left cable means, the sash including a glass panel and a frame member attached to the upper edge of the weights whereby the total weight of the sash can be adjusted relative to the weight of the counterbalance by inserting one or more weights into the receptacle.

8. The structure of claim 7 in which the counterbalance comprises a container and weight material within the container whereby the weight of the counterbalance can be varied by adding or removing weight material to or from the container.

9. In a fume hood having a top, a back, and right and left sides forming a working chamber back of a sash mounted for movement between raised and lowered positions for opening or closing the working chamber, an improved sash counterbalance apparatus comprising right and left cable means attached to right and left sides of the sash for operatively connecting a counterbalance to the sash, cable routing means on the top of the fume hood for routing the cable means over the top of the hood and down the back thereof, a counterbalance behind the back of the hood attached to the right and left cable means, and a roller rotatably mounted on the counterbalance and engageable with the backof the hood for preventing sliding contact between the counterbalance and the back of the hood as the sash is raised and lowered.

10. In a fume hood having a top, a back, and right and left sides forming a working chamber and a sash mounted for movement between raised and lowered positions for opening or closing the working chamber, an improved sash counterbalance apparatus comprising right and left cable means attached to right and left sides of the sash for operatively connecting a counterbalance to the sash, cable routing means on the top of the fume hood for routing the cable means over the top of the hood and down the back thereof, a counterbalance behind the back of the hood attached to the right and left cable means, the routing means including a first pair of pulleys mounted on the hood above the sash and generally aligned with the sides of the sash, a second pair of pulleys mounted on the top of the hood adjacent the back of the hood, and a third pair of pulleys mounted on the top of the hood adjacent the back of the hood and generally aligned with the middle of the hood, each of the right and left cable means being routed over one of the pulleys of each pair of pulleys.

11. The structure of claim 10 in which each pulley of the first pair of pulleys is mounted for rotation about a generally horizontal axis extending generally parallel to the back of the hood, each pulley of the second pair of pulleys is mounted for rotation about a generally vertical axis, and each pulley of the third pair of pulleys is mounted for rotation about a generally horizontal axis extending generally perpendicularly to the back of the hood.

12. The structure of claim 10 in which the right and left cable means comprise a single cable having each end thereof attached to the sides of the sash and the middle thereof attached to the counterbalance to provide the right and left portions of the cable.

13. The structure of claim 10 in which the counterbalance comprises a container and weight material within the container whereby the weight of the counterbalance can be varied by adding or removing weight material to or from the container.

14. The structure of claim 13 including a roller rotatably mounted on the container and engageable with the back of the hood for preventing sliding contact between the container and the back of the hood as the sash is raised and lowered.

* * * * *